US006838971B2

(12) United States Patent
Senda et al.

(10) Patent No.: US 6,838,971 B2
(45) Date of Patent: Jan. 4, 2005

(54) THERMAL FUSE

(75) Inventors: Kenji Senda, Fukui (JP); Takahiro Mukai, Miyazaki (JP)

(73) Assignee: Matsushita Electric Industrial Co., Ltd. (JP)

( * ) Notice: Subject to any disclaimer, the term of this patent is extended or adjusted under 35 U.S.C. 154(b) by 42 days.

(21) Appl. No.: 10/333,362

(22) PCT Filed: May 21, 2002

(86) PCT No.: PCT/JP02/04917

§ 371 (c)(1),
(2), (4) Date: Mar. 5, 2003

(87) PCT Pub. No.: WO02/095783

PCT Pub. Date: Nov. 28, 2002

(65) Prior Publication Data

US 2003/0156007 A1 Aug. 21, 2003

(51) Int. Cl.[7] ..... H01H 85/06; H01H 85/05

(52) U.S. Cl. ..... 337/296; 337/295; 337/297; 337/159; 337/416; 29/623

(58) Field of Search ..... 337/159, 187, 337/222, 290, 296, 297, 295, 401, 404, 405, 416; 29/623

(56) References Cited

U.S. PATENT DOCUMENTS

| | | | | | |
|---|---|---|---|---|---|
| 3,168,632 | A | * | 2/1965 | Baran | 337/227 |
| 3,201,646 | A | * | 8/1965 | Mansfield, Jr. | 315/239 |
| 3,377,448 | A | * | 4/1968 | Baumbach | 337/401 |
| 4,198,617 | A | * | 4/1980 | Hara | 337/403 |
| 4,494,104 | A | * | 1/1985 | Holmes | 337/403 |
| 4,873,506 | A | * | 10/1989 | Gurevich | 337/290 |
| 5,032,817 | A | * | 7/1991 | Morrill et al. | 337/247 |
| 5,097,247 | A | * | 3/1992 | Doerrwaechter | 337/405 |
| 5,712,610 | A | * | 1/1998 | Takeichi et al. | 337/290 |
| 5,777,540 | A | * | 7/1998 | Dedert et al. | 337/142 |
| 5,982,268 | A | * | 11/1999 | Kawanishi | 337/297 |

FOREIGN PATENT DOCUMENTS

| | | | | |
|---|---|---|---|---|
| DE | 2808319 A | * | 9/1979 | H01H/37/76 |
| JP | 2-291624 | | 12/1990 | |
| JP | 04144020 A | * | 5/1992 | H01H/37/76 |
| JP | 05258653 A | * | 10/1993 | H01H/37/76 |
| JP | 8-31283 | | 2/1996 | |
| JP | 2000-113784 | | 4/2000 | |
| JP | 2000-164093 | | 6/2000 | |
| JP | 2000-322994 | | 11/2000 | |
| JP | 2002-226790 | | 8/2002 | |

* cited by examiner

*Primary Examiner*—Anatoly Vortman
(74) *Attorney, Agent, or Firm*—Parkhurst & Wendel, L.L.P.

(57) ABSTRACT

Quantity of flux coated on fusible alloy of a thermal fuse disclosed can be inspected accurately by an image processing method. The thermal fuse comprises:

(a) first insulation film 11 coupled with a pair of metal terminals 12;

(b) fusible alloy 13 coupled between ends of the metal terminals 12, being placed above first insulation film 11;

(c) flux 14 coated on fusible alloy 13; and (d) second insulation film 15 disposed on first insulation film 11 so that an internal space is formed, being placed above fusible alloy 13, wherein at least either of first insulation film 11 or second insulation film 15 is transparent or translucent, and flux 14 has the Gardner color scale from 4 to 16.

16 Claims, 3 Drawing Sheets

THERMAL FUSE

TECHNICAL FIELD

The present invention relates to a thermal fuse.

BACKGROUND ART

Recent development of thin downsized secondary battery requires strongly a low-profile thermal fuse. Because current portable devices such as cellphones, notebook computers or video cameras and the like mainly adopt high capacity lithium-ion or lithium-polymer secondary batteries used in conjunction with thermal fuses.

A typical thermal fuse is composed of fusible alloys having low melting temperature.

A known conventional thermal fuse is disclosed in the Japanese Patent Application Non-Examined Publication No. H2-291624.

FIG. 3A illustrates a plan view, partly in section, showing a conventional thermal fuse. FIG. 3B illustrates a sectional view taken along the line 3B—3B in FIG. 3A.

As shown in FIGS. 3A and 3B, a conventional thermal fuse has a pair of metal terminal 1 each mounted on bottom surface of insulation film 2, protruding a portion of metal terminals 1 from bottom surface to out of upper surface of insulation film 2. Fusible alloy 4 is coupled between protruding ends of a pair of metal terminals 1. Fusible alloy 4 is coated with flux 3. Flux coating is applied on fusible alloy 4 by dripping with heat-liquefied flux 3. Insulation cover film 5 is disposed above insulation film 2 to cover fusible alloy 4. Insulation cover film 5 is preferably transparent or translucent enable to see inside conditions of the thermal fuse.

Certain degree of unavoidable fluctuation in coating quantity of flux occurs in dripping with heat-liquefied flux 3 on fusible alloy 4. However, flux 3 can enhance cutting-off performance of fusible alloy 4 when the alloy fuses. Thermal fuse coated with insufficient quantity of flux, therefore, must be rejected in production inspection process as thermal fuse with insufficient flux shows poor characteristics in cutting-off action.

A downsized thermal fuse is especially needed today along with recent development of downsized batteries used in conjunction with thermal fuses. A thermal fuse that can be inspected on flux coating with high accuracy, therefore, is strongly required since visual check can hardly inspect the flux coating quantity in such downsized thermal fuses.

Typically, coating quantity of flux 3 is inspected by image processing method of color data as follows:

1) storing image data of reflected light or transmitted light from a thermal fuse illuminated by a fluorescent lamp using CCD camera or the like, and
2) inspecting coated quantity of flux 3 according to size of coated or non-coated area with flux indicated in color.

However, in above mentioned conventional thermal fuse, color of flux 3 varies transparent, yellow or dark brawn or the like due to composition fluctuation of raw materials. Color of flux 3 is expressed in "color scale" as an indicator. In general, "color scale" stands for "Gardner color scale" that specifies color degree of an isopropyl alcohol solution containing 30 wt % of flux. Usually the Gardner color scale is called merely as color scale, so hereafter referred to color scale. The smaller in color scale, the closer to transparent, and the larger in color scale, the closer from yellow, brown to dark brown. In a case, when flux 3 has a small color scale, closer to transparent, it is hard to distinguish in color between flux 3 and insulation cover film 5. On the other hand, when flux 3 has a large color scale, closer to dark brown, inspection accuracy decreases to distinguish in color between flux 3 and fusible alloy 4.

As mentioned above, the drawback in conventional art is that image processing method using CCD camera and the like can not inspect flux coating quantity of thermal fuse with high accuracy due to fluctuation in color of flux 3.

DISCLOSURE OF INVENTION

A thermal fuse disclosed in this invention comprises:

(a) a pair of metal terminals;

(b) a first insulation film coupled with the metal terminals;

(c) a fusible alloy coupled between ends of the metal terminals, being placed on upper side of the first insulation film;

(d) a flux coated on the fusible alloy; and (e) a second insulation film disposed on the first insulation film so that an internal space is formed, being placed above the fusible alloy, wherein at least either of the first insulation film and the second insulation film is transparent or translucent, and the flux has the color scale from 4 to 16.

At least either of the first insulation film or the second insulation film of this thermal fuse is transparent or translucent, and the flux has the color scale from 4 to 16. So the image processing method can inspect thermal fuse on flux coating without inspection error of judging as "transparent" owing to too small color scale of flux, and can easily distinguish between flux and fusible alloy due to not too large color scale of flux. Consequently, the thermal fuse is disclosed whose flux coating quantity on fusible alloy can be accurately inspected by the image processing method.

BEST MODE FOR CARRYING OUT THE INVENTION (Exemplary Embodiment 1)

Figure 1A:
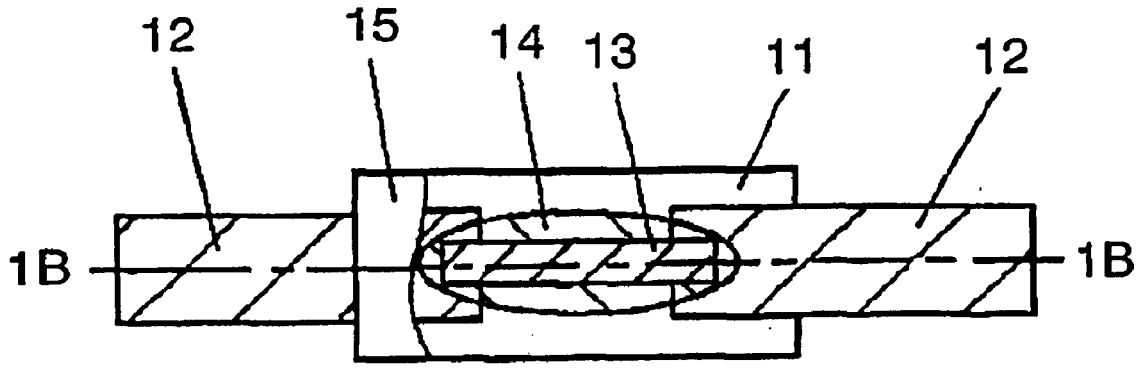
FIG. 1A illustrates a plan view, partly in section, showing a thermal fuse used in the first exemplary embodiment of the present invention.
Figure 1B:
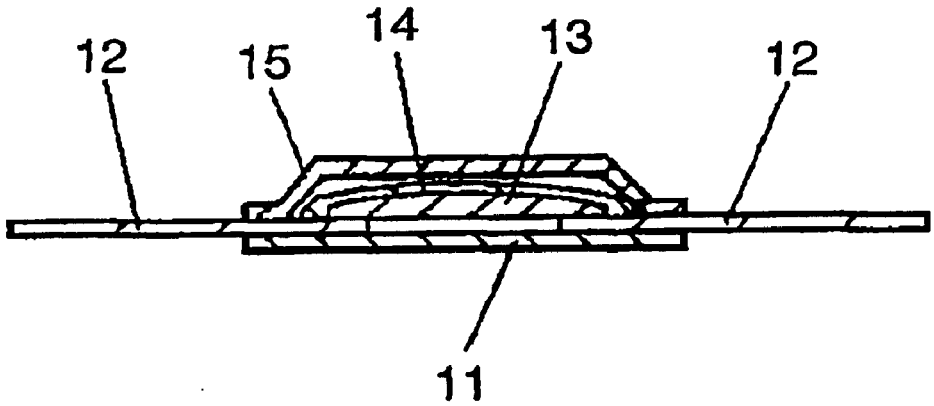
FIG. 1B illustrates a sectional view taken along the line 1B—1B in FIG. 1A.

FIG. 1A is a plan view, partly in section, showing a thermal fuse used in exemplary embodiment 1. FIG. 1B is a sectional view taken along the line 1B—1B in FIG. 1A.

A thermal fuse used in exemplary embodiment 1 comprises a sheet shaped first insulation film 11, composed of resin such as polyethylene terephthalate, polyethylene naphthalete or the like, coupled with a pair of metal terminals 12 having narrower width than first insulation film 11 as shown in FIGS. 1A and 1B. A pair of metal terminals 12, stripe shaped or line shaped, is composed of highly electrical conductive metal such as copper, nickel or the like whose surface is plated by solder, tin, copper or the like. Being placed above first insulation film 11, fusible alloy 13 is coupled between ends of metal terminals 12. Fusible alloy 13 consists of one of following metals: tin, lead, zinc, bismuth, indium, cadmium, silver and copper, or an alloy composed of a plurality of above mentioned metals.

Fusible alloy 13 is coated with flux 14, a resin mainly composed of rosin. Additionally, flux 14 has the Gardner Color Scale (hereafter referred to color scale) from 4 to 16. Several kinds of additives are mixed into the rosin to provide flux 14 with required mechanical and chemical properties. The color scale of flux can be controlled by conditioning temperature and time of heat-melting in additives mixing process, doping pigment or selecting purity of raw material rosin.

Being placed above fusible alloy 13, second insulation film 15 is disposed on first insulation film 11 by sealing so that an internal space is formed. Material of second insulation film 15 should preferably be the same as first insulation film 11. As mentioned above, first insulation film 11 and second insulation film 15 are secured by hermetic sealing, in peripheral portions of first insulation film 11 and second insulation film 15 except portion where fusible alloy 13 is held, so that both insulation films cover fusible alloy 13 to prevent fusible alloy 13 from changing in quality.

In addition, at least either of first insulation film 11 or second insulation film 15 of a thermal fuse is preferably transparent or translucent having light transmittance properties enable to see internal conditions of the thermal fuse from outside.

Illuminating with a fluorescent lamp or the like, reflected or transmitted light from a transparent or translucent insulation film of a thermal fuse is stored as image data of the light using CCD camera or the like. Coating quantity of flux 14 is inspected according to size of coated or non-coated area with flux 14 indicated in color. Needless to say, at least either of first insulation film 11 or second insulation film 15 is preferably transparent or translucent, since quantity of coated flux is inspected in color.

When configured as above, the image processing method can inspect thermal fuse on flux coating without judging error as "transparent" owing to too small color scale, and can distinguish between flux 24 and fusible alloy 23 easily due to not too large color scale. Consequently, the thermal fuse can be manufactured whose flux coating quantity on fusible alloy can be accurately inspected by the image processing method.

Now, inspection test results by image processing method are described on number of accepted in flux quantity in comparison with thermal fuses used in exemplary embodiment 1 and conventional thermal fuses.

1000 pieces of sample thermal fuses of the first exemplary embodiment (hereafter referred to embodiment) including flux 14 having color scale of 4, 5, 10, 15 and 16 respectively are used for the test. And 1000 pieces of sample thermal fuses of conventional art (hereafter referred to comparison) including flux having color scale of 2, 3, 17 and 18 respectively are also used for the test. The configuration of comparison is same as embodiment. Flux is coated in equal quantity for sample thermal fuses of both groups. Additionally, second insulation film 15 is composed of transparent polyethylene terephthalate of 100 $\mu$m thick.

Here, housing overall length of thermal fuse that consists of first insulation film 11, second insulation film 15 and fusible alloy 13 (equal to longer length of either first insulation film 11 or second insulation film 15) has a length of not shorter than 2.5 mm but not longer than 5.0 mm. Practically, thermal fuse with a housing length longer than 5.0 mm can hardly be used in conjunction with recent downsized batteries due to large setting area needed. Thermal fuse disclosed in this invention, therefore, has a housing length of not more than 5.0 mm. However, fusible alloy 13 does not open at the time of fusing if a thermal fuse has too small housingsaid length providing too narrow distance between metal terminals. Consequently, thermal fuse must suitably have a housing length not shorter than 2.5 mm but not longer than 5.0 mm. Here, the proto type thermal fuse has a housing length of 4.0 mm.

The test steps are as follows:

1) illuminate a sample thermal fuse from above second insulation film 15 by a fluorescent lamp, the sample thermal fuse having no flux 14 coated provided beforehand for image data registration;
2) import reflected light as image data using CCD camera;
3) convert the imported image data to pixel data;
4) store color image data of internal space formed between first insulation film 11 and second insulation film 15 as color image data with no flux 14.
5) next, illuminate each of 1000 pieces of sample thermal fuse from above second insulation film 15 by a fluorescent lamp, then import the reflected light as image data using CCD camera, and inspect a size of area showing corresponding color data stored in step 4) as area coated with no flux.
6) reject sample thermal fuse in which area judged as no flux in step 5) occupies larger than 50% of area of internal space formed between first insulation film 11 and second insulation film 15, when viewed from above.

The table as follows shows the inspection test results.

| Color scale | Comparison | | Embodiment | | | | | Comparison | |
|---|---|---|---|---|---|---|---|---|---|
| of flux | 2 | 3 | 4 | 5 | 10 | 15 | 16 | 17 | 18 |
| Number of accepted | 532 | 923 | 1000 | 1000 | 1000 | 1000 | 1000 | 987 | 862 |
| Number of rejected | 468 | 77 | 0 | 0 | 0 | 0 | 0 | 13 | 138 |

As clear from The table, some of comparison samples having color scale of 2, 3, 17 and 18 respectively are rejected due to inspection errors, while embodiment samples having color scale of 4, 5, 10, 15 and 16 respectively are all accepted.

Namely, the thermal fuse is manufactured whose flux coating quantity on fusible alloy can be accurately inspected by the image processing method if flux 14 has a color scale setting from 4 to 16 as described in this exemplary embodiment.

(Exemplary Embodiment 2)

The thermal fuse disclosed in exemplary embodiment 2 has a height of an internal space formed between first insulation film 11 and second insulation film 15 described in exemplary embodiment 1:

not lower than 0.20 mm but lower than 0.35 mm and a color scale of flux 14 coated on fusible alloy 13:

from 6 to 16.

As configured above, flux 14 has a limited range of color scale of from 6 to 16, narrower than first exemplary embodiment, corresponding to the lower height of an internal space formed between first insulation film 11 and second insulation film 15. Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 3)

The thermal fuse disclosed in exemplary embodiment 3 has a height of an internal space formed between first insulation film 11 and second insulation film 15 described in exemplary embodiment 1:

not lower than 0.35 mm but lower than 0.65 mm and a color scale of flux 14 coated on fusible alloy 13:

from 5 to 15.

As configured above, flux 14 has a limited range of color scale, neither too large nor too small, corresponding to height of an internal space formed between first insulation film 11 and second insulation film 15.

Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 4)

The thermal fuse disclosed in exemplary embodiment 4 has a height of an internal space formed between first insulation film 11 and second insulation film 15 described in exemplary embodiment 1:

not lower than 0.65 mm but not higher than 1.00 mm and a color scale of flux 14 coated on fusible alloy 13:

from 4 to 14.

As configured above, flux 14 has a limited range of color scale, neither too large nor too small, corresponding to height of an internal space formed between first insulation film 11 and second insulation film 15.

Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 5)

The thermal fuse disclosed in exemplary embodiment 5 has a thickness of flux 14 coated on fusible alloy 13 described in exemplary embodiment 1:

not thinner than 0.20 mm but thinner than 0.35 mm, and a color scale of flux 14:

from 6 to 16.

As configured above, flux 14 has a limited range of color scale, neither too large nor too small, corresponding to thickness range of flux 14.

Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 6)

The thermal fuse disclosed in exemplary embodiment 6 has a thickness of flux 14 coated on fusible alloy 13 described in exemplary embodiment 1:

not thinner than 0.35 mm but thinner than 0.65 mm, and a color scale of flux 14:

from 5 to 15.

As configured above, flux 14 has a limited range of color scale, neither too large nor too small, corresponding to thickness range of flux 14.

Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 7)

The thermal fuse disclosed in exemplary embodiment 7 has a thickness of flux 14 coated on fusible alloy 13 described in exemplary embodiment 1:

not thinner than 0.65 mm but not thicker than 1.00 mm, and a color scale of flux 14:

from 4 to 14.

As configured above, flux 14 has a limited range of color scale, neither too large nor too small, corresponding to thickness range of flux 14.

Consequently, the image processing method can inspect thermal fuse on flux coating without any error due to judging as "transparent", and can easily distinguish between flux 14 and fusible alloy 13, resulting a more accurate inspection on coating quantity of flux 14.

(Exemplary Embodiment 8)

Figure 2A:
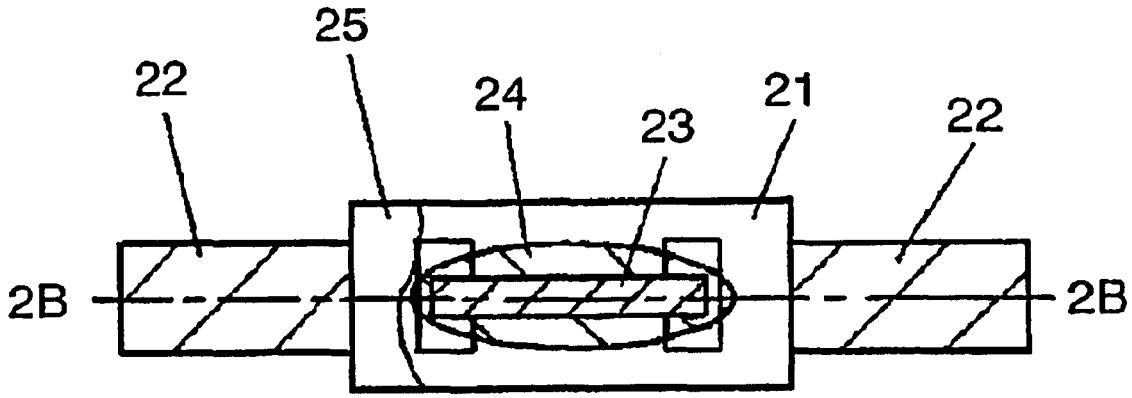
FIG. 2A illustrates a plan view, partly in section, showing a thermal fuse used in the eighth exemplary embodiment of the present invention.
Figure 2B:
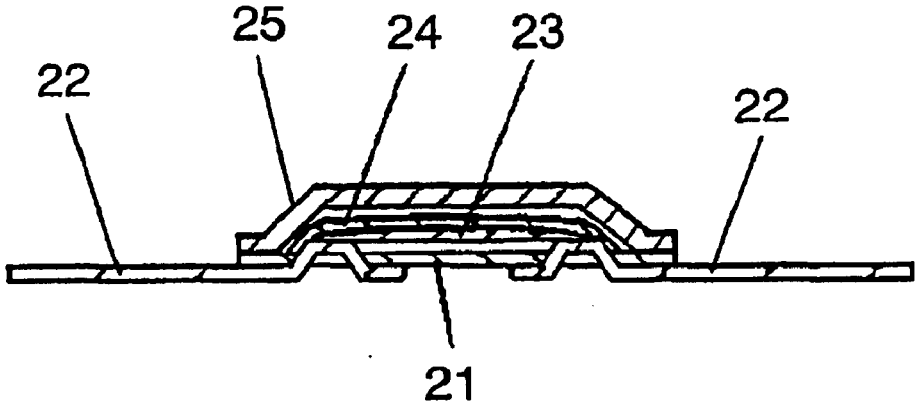
FIG. 2B illustrates a sectional view taken along the line 2B—2B in FIG. 2A.
Figure 3A:
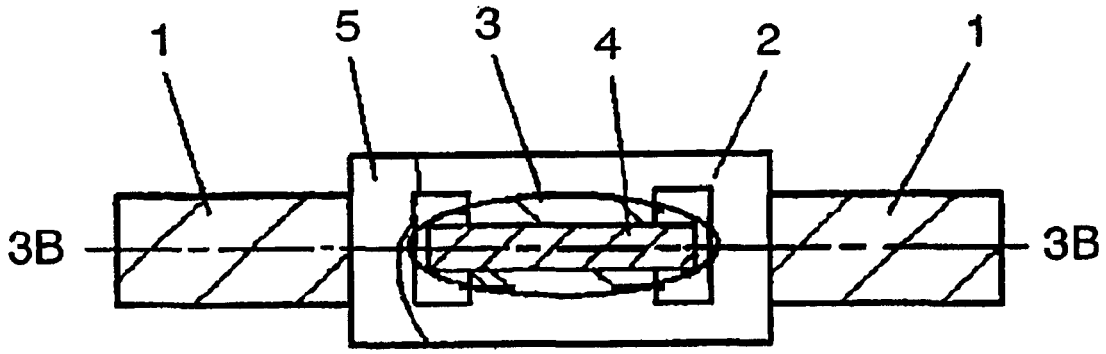
FIG. 3A PRIOR ART
FIG. 3A illustrates a plan view, partly in section, showing a conventional thermal fuse.
Figure 3B:
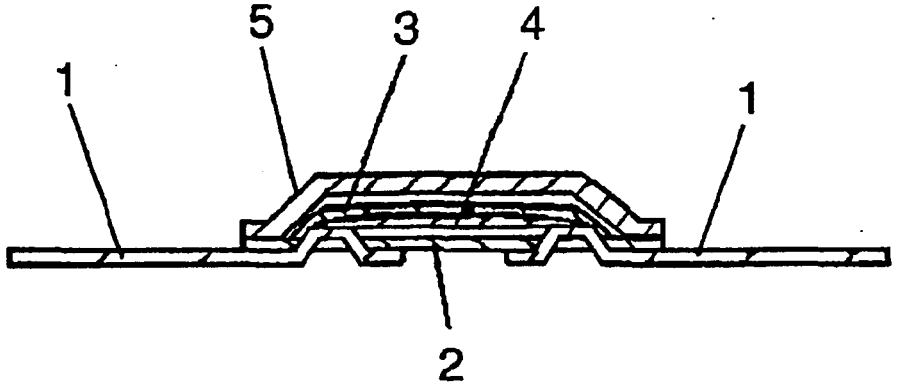
FIG. 3B PRIOR ART
FIG. 3B illustrates a sectional view taken along the line 3B—3B in FIG. 3A.

FIG. 2A illustrates a plan view, partly in section, showing a thermal fuse used in exemplary embodiment 8. FIG. 2B illustrates a sectional view of a thermal fuse taken along the line 2B–2B in FIG. 2A.

As shown in FIGS. 2A and 2B, a thermal fuse disclosed in exemplary embodiment 8 comprises a sheet shaped first insulation film 21, composed of resin such as polyethylene terephthalate, polyethylene naphthalete or the like, coupled with a pair of metal terminals 22. End portions of metal terminals 22 protrude out of upper surface from bottom surface of insulation film 21. The other configurations are the same as described in exemplary embodiment 1.

As configured above, the image processing method can inspect thermal fuse on flux 24 coating without judging error as "transparent" owing to too small color scale, and can easily distinguish between flux 24 and fusible alloy 23 due to not too large color scale. Consequently, the thermal fuse is disclosed whose flux coating quantity on fusible alloy can be accurately inspected by the image processing method.

Additionally, fusible alloy 23 is coupled between end portions of metal terminals 22, which protrude out of upper surface of insulation film 21 but in only small areas. Fusible alloy 23, therefore, does not open easily since only small area on metal terminal 22 is left for fused alloy 23 to move away. The inspection on coating quantity of flux 24 is very important to increase a cutting-off performance of a thermal fuse in the above configuration.

Setting of color scale for flux 24 in the eighth exemplary embodiment, therefore, enables to inspect coating quantity of flux 24 very significantly.

(Exemplary Embodiment 9)

The thermal fuse disclosed in exemplary embodiment 9 has a height of an internal space formed between first insulation film 21 and second insulation film 25 described in exemplary embodiment 8:

not lower than 0.20 mm but lower than 0.35 mm and a color scale of flux 24 coated on fusible alloy 23:

from 6 to 16.

As configured above, flux 24 has a limited range of color scale, neither too large nor too small, corresponding to height of an internal space formed between first insulation film 21 and second insulation film 25.

Consequently, the image processing method can inspect thermal fuse on flux coating without any error due to judging as "transparent", and can easily distinguish between flux 24 and fusible alloy 23, resulting a more accurate inspection on coating quantity of flux 24.

(Exemplary Embodiment 10)

The thermal fuse disclosed in exemplary embodiment 10 has a height of an internal space formed between first insulation film 21 and second insulation film 25 described in exemplary embodiment 8:

not lower than 0.35 mm but lower than 0.65 mm and a color scale of flux 24 coated on fusible alloy 23:

from 5 to 15

As configured above, flux 24 has a limited range of color scale, neither too large nor too small, corresponding to height of an internal space formed between first insulation film 21 and second insulation film 25.

Consequently, the image processing method can inspect thermal fuse on flux coating without any error due to judging as "transparent", and can easily distinguish between flux 24 and fusible alloy 23, resulting a more accurate inspection on coating quantity of flux 24.

(Exemplary Embodiment 11)

The thermal fuse disclosed in exemplary embodiment 11 has a height of an internal space formed between first insulation film 21 and second insulation film 25 described in exemplary embodiment 8:

not lower than 0.65 mm but not higher than 1.0 mm and a color scale of flux 24 coated on fusible alloy 23:

from 4 to 14

As configured above, flux 24 has a limited range of color scale, neither too large nor too small, corresponding to height of an internal space formed between first insulation film 21 and second insulation film 25.

Consequently, the image processing method can inspect thermal fuse on flux coating without any error due to judging as "transparent", and can easily distinguish between flux 24 and fusible alloy 23, resulting a more accurate inspection on coating quantity of flux 24.

(Exemplary Embodiment 12)

The thermal fuse disclosed in exemplary embodiment 12 has a thickness of flux 24 coated on fusible alloy 23 described in exemplary embodiment 8:

not thinner than 0.20 mm but thinner than 0.35 mm, and a color scale of flux 24:

from 6 to 16.

As configured above, flux 24 has a limited range of color scale, neither too large nor too small, corresponding to thickness range of flux 24.

Consequently, the image processing method can inspect thermal fuse on flux coating without any error due to judging as "transparent", and can easily distinguish between flux 24 and fusible alloy 23, resulting a more accurate inspection on coating quantity of flux 24.

(Exemplary Embodiment 13)

The thermal fuse disclosed in exemplary embodiment 13 has a thickness of flux 24 coated on fusible alloy 23 described in exemplary embodiment 8:

not thinner than 0.35 mm but thinner than 0.65 mm, and a color scale of flux 24:

from 5 to 15.

As configured above, flux 24 has a limited range of color scale, neither too large nor too small, corresponding to thickness range of flux 24.

Consequently, the image processing method can inspect thermal fuse on flux coating without any error due to judging as "transparent", and can easily distinguish between flux 24 and fusible alloy 23, resulting a more accurate inspection on coating quantity of flux 24.

(Exemplary Embodiment 14)

The thermal fuse disclosed in exemplary embodiment 14 has a thickness of flux 24 coated on fusible alloy 23 described in exemplary embodiment 8:

not thinner than 0.65 mm but not thicker than 1.00 mm, and a color scale of flux 24:

from 4 to 14.

As configured above, flux 24 has a limited range of color scale, neither too large nor too small, corresponding to thickness range of flux 24.

Consequently, the image processing method can inspect thermal fuse on flux coating without any error due to judging as "transparent", and can easily distinguish between flux 24 and fusible alloy 23, resulting a more accurate inspection on coating quantity of flux 24.

INDUSTRIAL APPLICABILITY

The thermal fuse disclosed in this invention comprises:

(a) a pair of metal terminals;

(b) a first insulation film coupled with the metal terminals;

(c) a fusible alloy coupled between ends of the metal terminals, being placed above the first insulation film;

(d) a flux coated on the fusible alloy; and (e) a second insulation film disposed on the first insulation film so that an internal space is formed, being placed above the fusible alloy, wherein at least either of the first insulation film or the second insulation film is transparent or translucent, and the flux has a color scale from 4 to 16.

As configured above, the image processing method can inspect thermal fuse on flux coating without judging error as "transparent" owing to too small color scale, and can easily distinguish between flux and fusible alloy due to not too large color scale.

Consequently, the thermal fuse is disclosed whose flux coating quantity on fusible alloy can be accurately inspected by the image processing method.

What is claimed is:

1. A thermal fuse comprises:

(a) a pair of metal terminals;

(b) a first insulation film coupled with said pair of metal terminals;

(c) a fusible alloy coupled between ends of said pair of metal terminals, being placed above said first insulation film;

(d) a flux coated on said fusible alloy; and (e) a second insulation film disposed on said first insulation film so that an internal space is formed, being placed above said fusible alloy, wherein at least either of said first insulation film or said second insulation film is transparent or translucent, and said flux has the Gardner color scale (hereafter referred to color scale) from 4 to 16.

2. The thermal fuse of claim 1, wherein an internal space formed between said first insulation film and said second insulation film has a height of at least 0.20 mm and lower than 0.35 mm and said flux has a color scale from 6 to 16.

3. The thermal fuse of claim 1, wherein an internal space formed between said first insulation film and said second insulation film has a height of at least 0.35 mm and lower than 0.65 mm and said flux has a color scale from 5 to 15.

4. The thermal fuse of claim 1, wherein an internal space formed between said first insulation film and said second insulation film has a height of at least 0.65 mm and at most 1.00 mm and said flux has a color scale from 4 to 14.

5. The thermal fuse of claim 1, wherein said flux has a thickness of at least 0.20 mm and thinner than 0.35 mm and has a color scale from 6 to 16.

6. The thermal fuse of claim 1, wherein said flux has a thickness of at least 0.35 mm and thinner than 0.65 mm and has a color scale from 5 to 15.

7. The thermal fuse of claim 1, wherein said flux has a thickness of at least 0.65 mm and at most 1.00 mm and has a color scale from 4 to 14.

8. A thermal fuse of claim 1, said fuse further comprising a housing, wherein the housing overall length consists of first insulation film, second insulation film and fusible alloy has a length of not shorter than 2.5 mm but not longer than 5.0 mm.

9. A thermal fuse comprises:

(a) a pair of metal terminals;

(b) a first insulation film coupled with said pair of metal terminals such that end portion of said each pair of metal terminal protrudes from bottom surface to out of upper surface of said first insulation film;

(c) a fusible alloy coupled between ends of said pair of metal terminals which protrude out of upper surface of said first insulation film;

(d) a flux coated on said fusible alloy; and (e) a second insulation film disposed on said first insulation film so that an internal space is formed, being placed above said fusible alloy, wherein at least either of said first insulation film or said second insulation film must be transparent or translucent, and said flux has the Gardner color scale (hereafter referred to as color scale) from 4 to 16.

10. The thermal fuse of claim 9, wherein an internal space formed between said first insulation film and said second insulation film has a height of at least 0.20 mm and lower than 0.35 mm and said flux has a color scale from 6 to 16.

11. The thermal fuse of claim 9, wherein an internal space formed between said first insulation film and said second insulation film has a height of at least 0.35 mm and lower than 0.65 mm and said flux has a color scale from 5 to 15.

12. The thermal fuse of claim 9, wherein an internal space formed between said first insulation film and said second insulation film has a height of at least 0.65 mm and at most 1.00 mm and said flux has a color scale from 4 to 14.

13. The thermal fuse of claim 9, wherein said flux has a thickness of at least 0.20 mm and thinner than 0.35 mm and has a color scale from 6 to 16.

14. The thermal fuse of claim 9, wherein said flux has a thickness of at least 0.35 mm and thinner than 0.65 mm and has a color scale from 5 to 15.

15. The thermal fuse of claim 9, wherein said flux has a thickness of at least 0.65 mm and at most 1.00 mm and has a color scale from 4 to 14.

16. A thermal fuse of claim 9, said fuse further comprising a housing, wherein the housing overall length consists of first insulation film, second insulation film and fusible alloy has a length of not shorter than 2.5 mm but not longer than 5.0 mm.

* * * * *

UNITED STATES PATENT AND TRADEMARK OFFICE

CERTIFICATE OF CORRECTION

PATENT NO. : 6,838,971 B2
DATED : January 4, 2005
INVENTOR(S) : Kenji Senda et al.

It is certified that error appears in the above-identified patent and that said Letters Patent is hereby corrected as shown below:

Title page,
Item [30], Foreign Application Priority Data, please add:
-- Item [30], Foreign Application Priority Data
May 21, 2001 (JP)……...2001-150510
Sep. 12, 2001 (JP)……...2001-276311 --.

Signed and Sealed this

Twenty-sixth Day of April, 2005

JON W. DUDAS
*Director of the United States Patent and Trademark Office*